United States Patent [19]

Zolman et al.

[11] 4,076,055

[45] Feb. 28, 1978

[54] WINDING MACHINE

[75] Inventors: Peter Martin Zolman; Keith Gilbert Doyle, both of Twickenham, England

[73] Assignee: Alfred Bader Limited, Surrey, England

[21] Appl. No.: 727,431

[22] Filed: Sep. 28, 1976

[30] Foreign Application Priority Data

Sep. 29, 1975 United Kingdom ..... 39777/75

[51] Int. Cl.[2] ..... B21F 3/04

[52] U.S. Cl. ..... 140/92.2; 242/7.15

[58] Field of Search ..... 140/92.2, 1; 242/158 R, 242/DIG. 1, 7.15, 7.16

[56] References Cited

U.S. PATENT DOCUMENTS

| | | | |
|---|---|---|---|
| 3,858,624 | 1/1975 | Sallin | 140/92.2 |
| 3,881,526 | 5/1975 | Bell et al. | 140/92.2 |

*Primary Examiner*—Lowell A. Larson

*Attorney, Agent, or Firm*—Emory L. Groff, Jr.

[57] ABSTRACT

A coil winding machine comprises a mandrel on which the coil is to be wound using a wire guide device for guiding the wire on to the mandrel, first and second electrical drive means for providing rotary motion and longitudinal motion between the mandrel and wire guide device and electrical control means for controlling and synchronizing the electrical drive means.

4 Claims, 8 Drawing Figures

| INPUT SOURCE | COUNTER | ACTION STARTED |
|---|---|---|
| CREEP CORRECTED | 0 | WAIT FOR WIRE FEED |
| WIRE FEED | 1 | BINARY CONVERSION AND RESET OF ARITHMETIC UNITS |
| CONVERSION AND RESET COMPLETED | 2 | START PREKINK WIND |
| END ACCELERATION | 3 | START DECELERATION |
| END OF WIND | 4 | RESET OF ARITHMETIC UNITS |
| RESET COMPLETED | 5 | START PREKINK RETURN |
| PREKINK RETURNED | 6 | WIND WHOLE TURNS |
| HALF OF WHOLE TURNS WOUND | 7 | WIND DEGREES |
| HALF DEGREES WOUND | 8 | WIND OVERWIND |
| END ACCELERATION | 9 | START DECELERATION |
| END OF WIND | 10 | RESET OF ARITHMETIC UNITS |
| RESET COMPLETED | 11 | RETURN OVERWIND |
| END ACCELERATION | 12 | START DECELERATION |
| END OF WIND | 13 | START MECHANICAL DRIVE AND RESET ARITHMETIC UNITS |
| RESET AND CUT COMPLETION | 14 | RETURN WIND DEGREES |
| END ACCELERATION | 15 | START DECELERATION |
| END OF WIND | 16 | RESET ARITHMETIC UNITS |
| RESET COMPLETED | 17 | RETURN PITCH |
| END ACCELERATION | 18 | START DECELERATION |
| END OF WIND | 19 | CORRECT CREEP |

FIG. 5

WINDING MACHINE

BACKGROUND OF THE INVENTION

This invention relates to winding machines and the invention is particularly applicable to winding machines for winding the filaments of electric lamp bulbs, particularly for the automotive industries.

Basically a winding machine of this nature incorporates a mandrel on which the wire coil of the filament is wound, and a wire guide or pitch mechanism which guides the wire relative to the mandrel so as to provide the necessary pitching of the coil of wire on the mandrel. The arrangement is so driven that the mandrel and wire guide rotate relative to each other to provide the coil while the wire guide additionally moves longitudinally of the mandrel to provide the desired pitch of the coil. It is to be observed that while, in probably the majority of these winding machines, the mandrel is rotated and the wire guide moves purely in the longitudinally direction, it is possible for the mandrel to remain stationary and for the wire guide to be driven with both a longitudinal and rotary motion. It is also possible for the mandrel to move both longitudinally and rotationally while the wire guide remains stationary.

In the more usual winding machines of this kind, the drive to the winding machine is provided, for example, from a single prime mover through various gearing for rotary movements and through the use of cam shafts and cam followers where straight line movements are required particularly for such ancilliary devices as wire cutters, would filament ejectors wire clamping arrangements, tail forming mechanisms and so forth.

With the actual winding and the coil pitch mechanisms, very accurate adjustments are necessary in order to be able to provide the correct number of turns, to take into account the required direction of the tails of the filament, to provide synchronisation between the pitch drive and the winding drive.

Not only is the accuracy necessary for the purposes of the actual winding but in many instances over winding or reverse winding has to be carried out in order that the filament tails shall have the correct angle when they are ejected from the machine. This to a great extent depends upon the resilience of the wire which is being wound and the tension which has been built up during the winding operation.

Further problems arise in that, in order for the filament winding machine to fit into the cycle of a lamp making line, it is necessary that the entire operation of winding a filament should take place, for example, in not more than two seconds. This requires the speed of winding to be built up to a very large figure, for example between 6,000 and 10,000 rpm. This is quite difficult with conventional mechanical drives due to the inertia which is inherent in the gear drive to the various parts of the mechanism.

Accurate adjustment of the required number of winding turns, which may be a combination of forwards and backwards winding for tall control purposes, requires a very high control over the gear ratios which are to be used in the operation. In many occasions the exact number of turns cannot be determined except experimentally and for this it is necessary to carry out a change in the gearing between each experimental operation to determine the exact number of winding turns required by a particular wire. Furthermore, any variation in the number of turns which may be required in producing, for example, a different series of lamps requires further experimentation in further gear changing. The difficulties in mechanically changing gears is increased by the fact that a large number of variations of the ratios may be required and with the necessity of having a very large number of spare gear wheels for this purpose.

SUMMARY OF THE INVENTION

It is an object of the invention to obviate or reduce some or all of the above described disadvantages which are inherent in the conventional drives of the lamp filament and the like winding machines.

According to the invention, a coil winding machine comprises a mandrel on which a coil is to be wound, a wire guide for guiding wire onto said mandrel in a correct position for forming a wire coil on said mandrel, first electrical drive means for providing a rotary motion between said mandrel and said wire guide, second electrical drive means for providing a longitudinal displacement between said mandrel and said wire guide and electrical control means connecting said first and second electrical drive means for controlling and synchronizing the operation of the first and second electrical drive means.

BRIEF DESCRIPTION OF THE DRAWINGS

The invention will now be described in greater detail, by way of example, with reference to the drawings, in which:

FIG. 5 is a table showing the stages in the electronic control of the machine;

DESCRIPTION OF THE PREFERRED EMBODIMENTS

Figure 1:
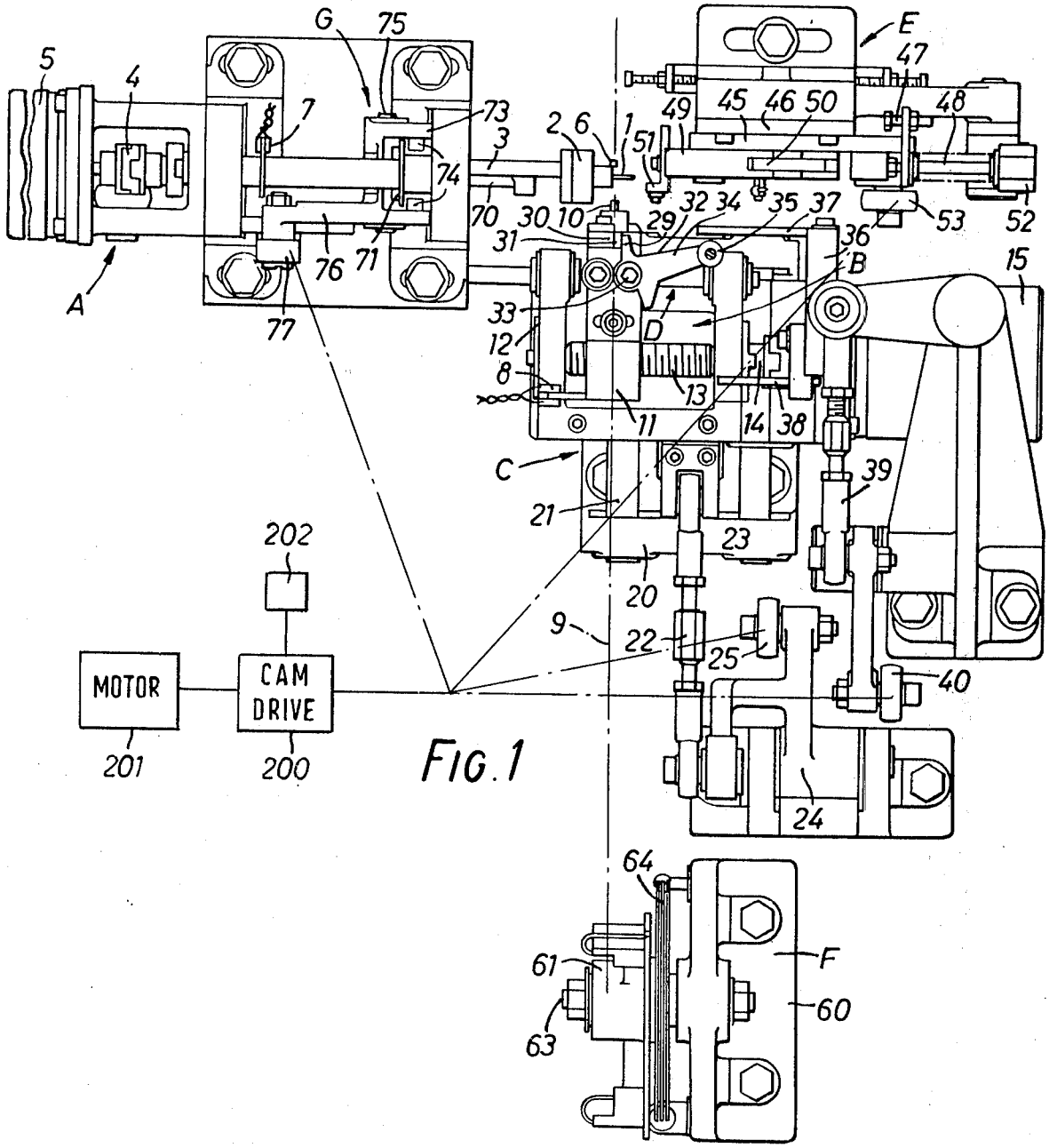
FIG. 1 is a plan view of one embodiment of a winding machine in accordance with the invention.

Referring firstly to FIG. 1 there is shown the basic operating parts of a winding machine in accordance with the invention, with the mechanical drive to the various mechanically driven parts shown schematically, together with their controlling cam shaft, 200 and cam operated relays 202 and electric drive motors 201.

Basically the winding machine can be said to consist of a number of different operational groups as follows:

A — Mandrel Drive
B — Pitch Mechanism
C — Wire Feed Machanism
D — Wire Clamp Mechanism
E — Wire Cutter Mechanism
F — Wire Supply Mechanism
G — Mandrel Retraction Mechanism Reference will now be made to the various sections:

A — Mandrel Drive

The mandrel drive section comprises a mandrel 1 which projects from a mandrel head 2 rotating on a rotary shaft 3. This shaft 3 is connected by a coupling 4 to a first stepping motor 5 (wind motor) which controls the rotation of the mandrel 1. As will be seen when considering the mandrel retraction mechanism G, the shaft 3 is hollow and mandrel 1 is longitudinally movable with respect to the shaft 3 for filament ejection purposes.

In addition to the movable mandrel 1, the mandrel head 2 is also provided with a wire gripper indicated diagrammatically at 6 whose operation is associated with the mandrel retraction mechanism G to be described hereafter. Also provided in the mandrel drive section A is a photo electric sensing device 7 which senses the angular position of the shaft 3 for reset purposes as will be later described.

B — Pitch Control Mechanism

The pitch control mechanism comprises a feed nozzle 10 through which the wire to be wound is passed, the wire following a path which is indicated on the drawing by the chain line 9. The wire feed nozzle 10 is carried by a pitch control carriage 11 which is in turn carried slidably on a feed carriage 12 so that the carriage 11 can slide in the longitudinal direction with respect to the mandrel 1.

This sliding movement of the pitch control carriage 11 is carried out by the provision of a rotating threaded shaft 13 which is connected through a coupling 14 to a second stepping motor 15 (pitch motor) controlling the rotation of the threaded shaft 13. The threaded shaft 13 cooperates with a non-rotatable threaded portion, not shown, in the carriage 11 whereby rotary movement of the threaded shaft 13 provides longitudinal movement of the pitch control carriage 11. As will be appreciated, this longitudinal movement of the feed nozzle 10 controls the pitch of the filament coil being wound.

A photo electric sensing device 8 which senses the starting position of the pitch control carriage 12 is also provided for reset purposes.

C — Wire Feed Mechanism

The wire feed mechanism controls forward and backward movement (as related to the wire feed) of the feed carriage 12 and has for its purpose to provide feed of the wire to the mandrel for a winding operation and also the control of the length of the tails of the filament being wound. The mechanism comprises a frame 20 provided with guide rods 21 on which the feed carriage 12 slides. The feed carriage 12 is moved forwards and backwards by means of a drive rod 22 coupled to the carriage 20 by means of a coupling 23. The drive rod 22 is in turn driven through a linkage 24 which is in turn driven by a lever, the end of which can be seen at 25. This lever 25 is driven by the cam shaft 200 of the mechanical drive of the machine.

D — Wire Clamp Mechanism

The wire clamp mechanism provides for the necessary clamping of the wire during the operation of the machine. This clamping is required at various times as will be explained hereafter. Thus it comprises a stationary jaw 30 which cooperates with a moving jaw 31 mounted on one arm 29 of a lever 32 pivotable on the carriage 11 at 33.

The arm 34 of the lever 32 is provided at its end with a roller 35 by means of which it is actuated by an actuating mechanism 36. The acutating mechanism 36 comprises a first arm 37 which extends past the roller 35 so that the roller 35 is engageable thereby during movement of the wire clamp drive mechanism 36. A further arm 38, also movable by the mechanism 36 is parallel to the arm 37 and moves therewith. The arm 38 is positioned to engage with the roller 35 in the unclamped position of the lever 32. The mechanism 36 is driven by means of a linkage 39 which is connected to a rod, the end of which can be seen at 40 which is in turn driven by the cam shaft 200 of the mechanical drive.

E — Wire Cutter Mechanism

The wire cutter mechanism comprises a carriage 45 which is movable in a direction longitudinally of the mandrel 1 and slides on slides 46. The sliding movement of the carriage 45 is controlled by means of a set screw 47 at one end. The carriage 45 is driven forwards and backwards through a linkage 48 which in turn is driven from the cam shaft 200 of the mechanical drive by way of a coupling 53 and a lever 52.

Carried by the carriage 45 are two cooperating cutter arms, the upper of which is indicated at 49. The cutter arms are pivoted together at 50 and carry out an up and down movement with respect of the plane of the drawing and thus in a direction at right angles to the line 9 of the wire. Two cooperating cutter blades are provided, one on each arm, the upper cutter blade being indicated at 51. The up and down movement of the cutter arms is controlled by further travel of the lever 52 after the carriage 45 has been stopped by the screw 47.

F — Wire Supply Mechanism

The wire supply mechanism comprises a frame 60 which carries a coil carrier 61 on which a coil of the wire to be wound (not shown) is mounted, fixed for rotation therewith. The coil carrier 61 is mounted on a shaft 63 and its motion is restricted by a braking mechanism 64 by means of which the wire being wound is maintained in tension.

G — Mandrel Retraction Mechanism

The mandrel retraction mechanism is provided in association with the mandrel drive A and comprises an inner mandrel rod arrangement 70 to which the mandrel 1 is attached. This mandrel rod 70 is in turn connected to a retraction flange 71 by means of which it can be moved forwards or backwards in the longitudinal direction of the mandrel 1.

This forwards and backwards movement is provided by a bifurcated arrangement 73 provided with a pair of rollers 74 which, for retraction purposes, engage on the flange 71. The mechanism 73 is moved pivotally, about a pivot 75, through a linkage 76 driven in turn by a lever 77 which is connected with the cam shaft 200 of the mechanical drive. Suitably, return of the mandrel to its extended position, as shown in the drawings, is carried out by a spring, whereby the roller 74 remains out of contact with the mandrel retraction flange 71 when the mandrel 1 is in its extended state, thus reducing the load on the shaft 3 during the actual coil winding operation.

Figure 2:
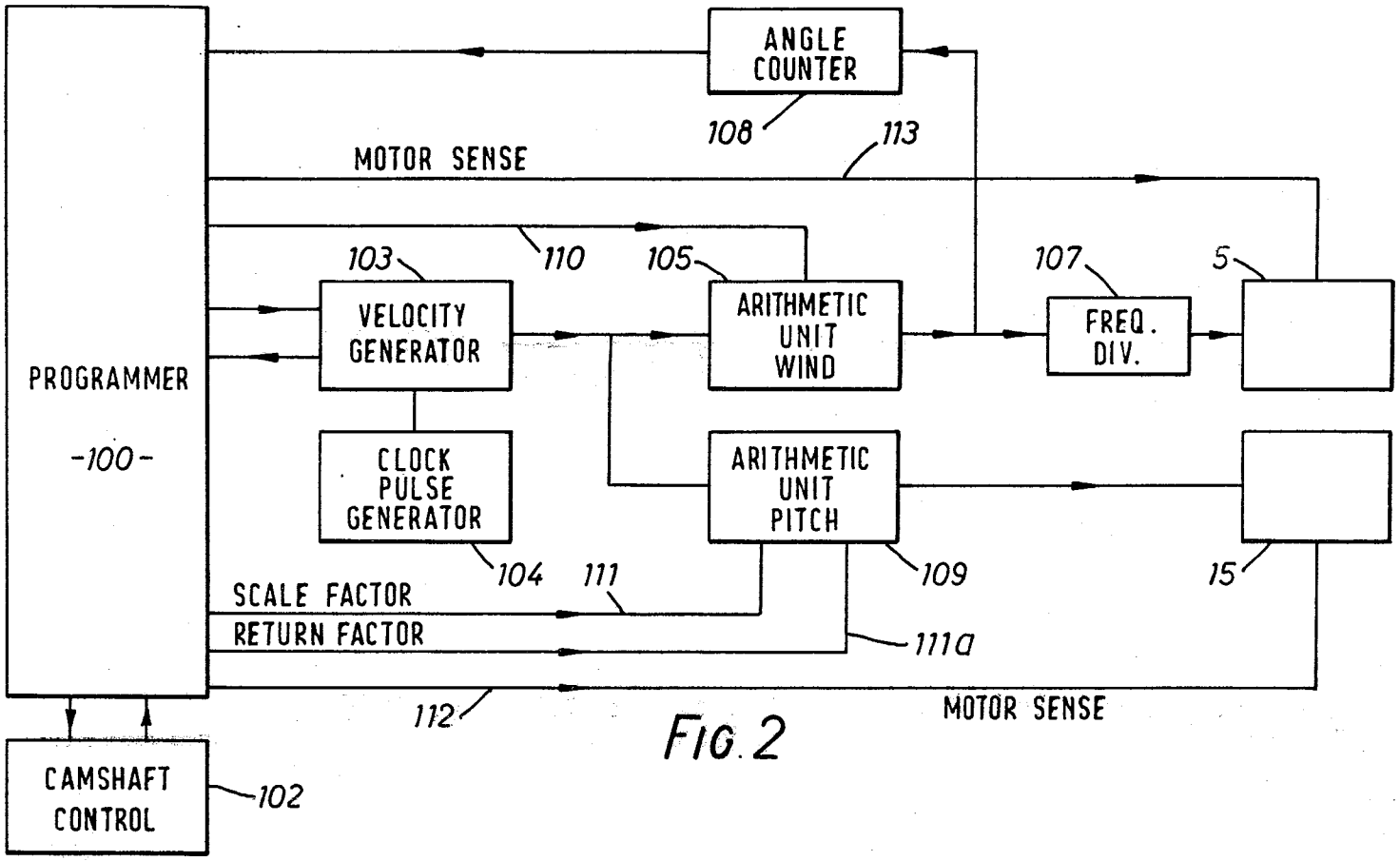
FIG. 2 is a block diagram of the electronic system controlling the operation of the setting motors providing the mandrel and pitch drives.

FIG. 2 shows a block diagram of the electronic equipment which is necessary for the control of the two stepping motors, the wind motor 5 and the pitch motor 15 so that they perform their required operations and also remain in synchronism.

In FIG. 2 a main programmer 100 is provided, on which all the variable parameters are set by means of dials. Since the dials will normally set the parameters in a binary code, conversion means are provided to convert the binary coded number into a full binary number as is required for drive purposes. It is connected to a cam shaft control arrangement which provides information as to the position of the cams of the main mechanical drive. This control arrangement is indicated by the box 102. By this means information as to the position of the various devices driven by the mechanical drive can be provided to the programmer 100 and the programmer 100 can, in turn, control the operation of the mechanical drive. Also connected to the programmer 100 is a velocity generator 103 which provides, under the control of the programmer 100 and under the control of a clock pulse generator 104, a binary number which is related to the rotational speed required by the stepping motors 5 and 15. Since the two motors will not be driven at the same speed, further factors will be inserted into the control of the stepping motors 5 and 15 as will be hereafter described.

Each of the motors 5 and 15 is driven by a drive circuit which causes the motor to rotate by one step each time a pulse is received by the drive circuit. Arithmetic units 105 and 109 are provided to generate pulses at a suitable rate so that the speed of the motor is proportional to the ratio of two numbers.

Figure 4:
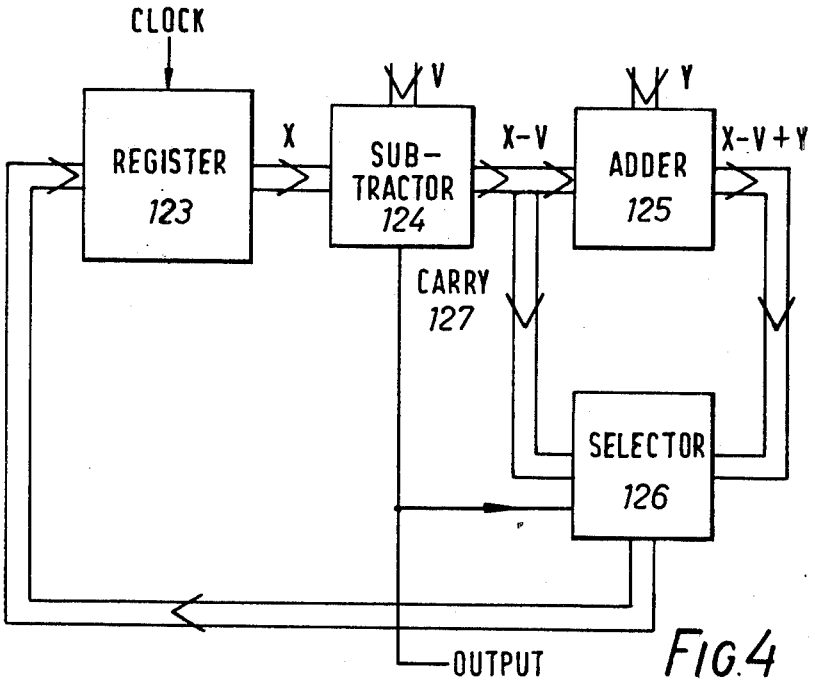
FIG. 4 is a block diagram showing the arithmetic units of FIG. 2.

A block diagram of the arithmetic unit is shown in FIG. 4. The binary number V is generated by the velocity generator 103. The number Y is a scale factor. The function of the arithmetic unit is to generate output pulses at a frequency proportional to V/Y. This is achieved by subtracting V from the contents X of the register 123 using a subtractor 124 to give a number X−V. An adder 125 is used to add Y to this number to give a further number X−V+Y. A carry line 127 generates a pulse if (X−V) is negative, and this causes (X−V+Y) to be fed into the register 123 by the selector 126. If (X−V) is positive, the selector 126 causes (X−V) to be fed to the register 123. The effect of this is that V is subtracted from X, the contents of the register 123, on every clock pulse, and as soon as the result is negative, Y is added in. The frequency with which (X−V) becomes negative is therefore proportioned to V/Y. The pulse which is generated when (X−V) becomes negative is used as the output of the arithmetic unit.

As mentioned, the output of the velocity generator 103 is connected to the first arithmetic unit 105 which controls the speed of the wind motor 5 providing the mandrel drive. To the arithmetic unit 105 is additionally applied a fixed scale factor Y which converts the binary number V from the velocity generator into the appropriate pulses for the operation on the wind motor 5. This scale factor which is provided on the line 110 is pre-set in the programmer 100. The output of the arithmetic unit 105 is fed through a frequency divider 107 to the wind motor 5 for the mandrel drive.

Information as to the angular position of the wind motor 5 is provided from the output of the arithmetic unit 105 which is connected to a counter 108 which counts one half the angle of the wind motor 5 and passes this count to the programmer 100.

The output of the velocity generator 103 is also supplied to the second arithmetic 109 which provides the necessary drive pulses for the pitch motor 15 controlling the drive of the pitch mechanism. In order that the pulses produced by the arithmetic unit should correspond to the actual drive required by the stepping motor 15, this arithmetic unit is additionally provided over two lines 111 and **111*a*** with two scale factors, the first of which represents-the number of turns per mm of the filament to be wound (and is a dialable variable) and the other and smaller factor is used for the return of the pitch mechanism to a starting point ready for winding the next coil.

Additionally the sense of rotation of the stepping motors 5 and 15 are controlled over lines 112 and 113 by the programmer 100. The return factor is normally, not variable but is preset.

In addition to the above described connections there is further a feed from the velocity generator 103 to the programmer 100 which provides a signal indicating the end of a winding operation.

Figure 3:
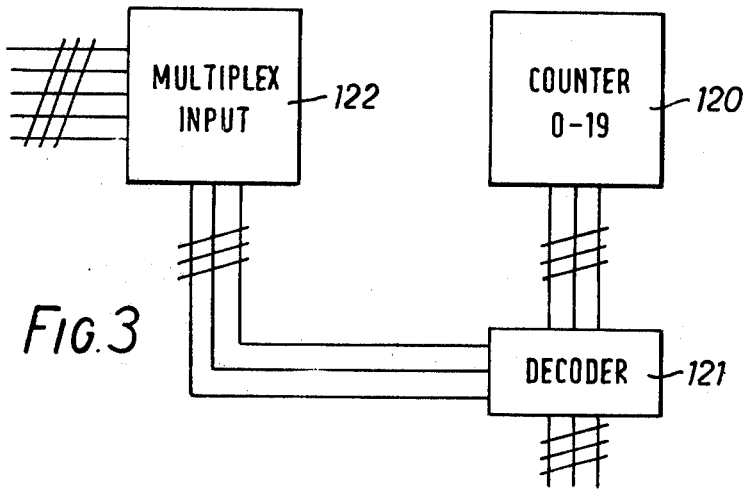
FIG. 3 is a block diagram showing a part of the programmer unit of FIG. 2.

FIG. 3 shows a portion of the programmer 100 which controls the sequence of operations of the winding machine. It will be appreciated that before this part of the programmer 100 comes into use, it is of course necessary to set up all the variable parameters which can be done, as mentioned by means of suitable dials provided on the outside of the programmer unit. This sequence control part of the programmer comprises a counter 120 which counts in a cycle from 0 to 19 and controls the sequence of operations in accordance with each count. This counter is connected to a de-coder 121 which, from the output of the counter provides the necessary outputs for actuating the various parts of the mechanism. The input to the counter is provided by a multiplex input network 122 to which are fed the various signals from the various parts of the machine indicating that certain functions have been carried out. Which of these signals is to be fed to the counter is also controlled by the de-coder 121 which determines what signals may next actuate a count of the counter 120.

Figure 6:
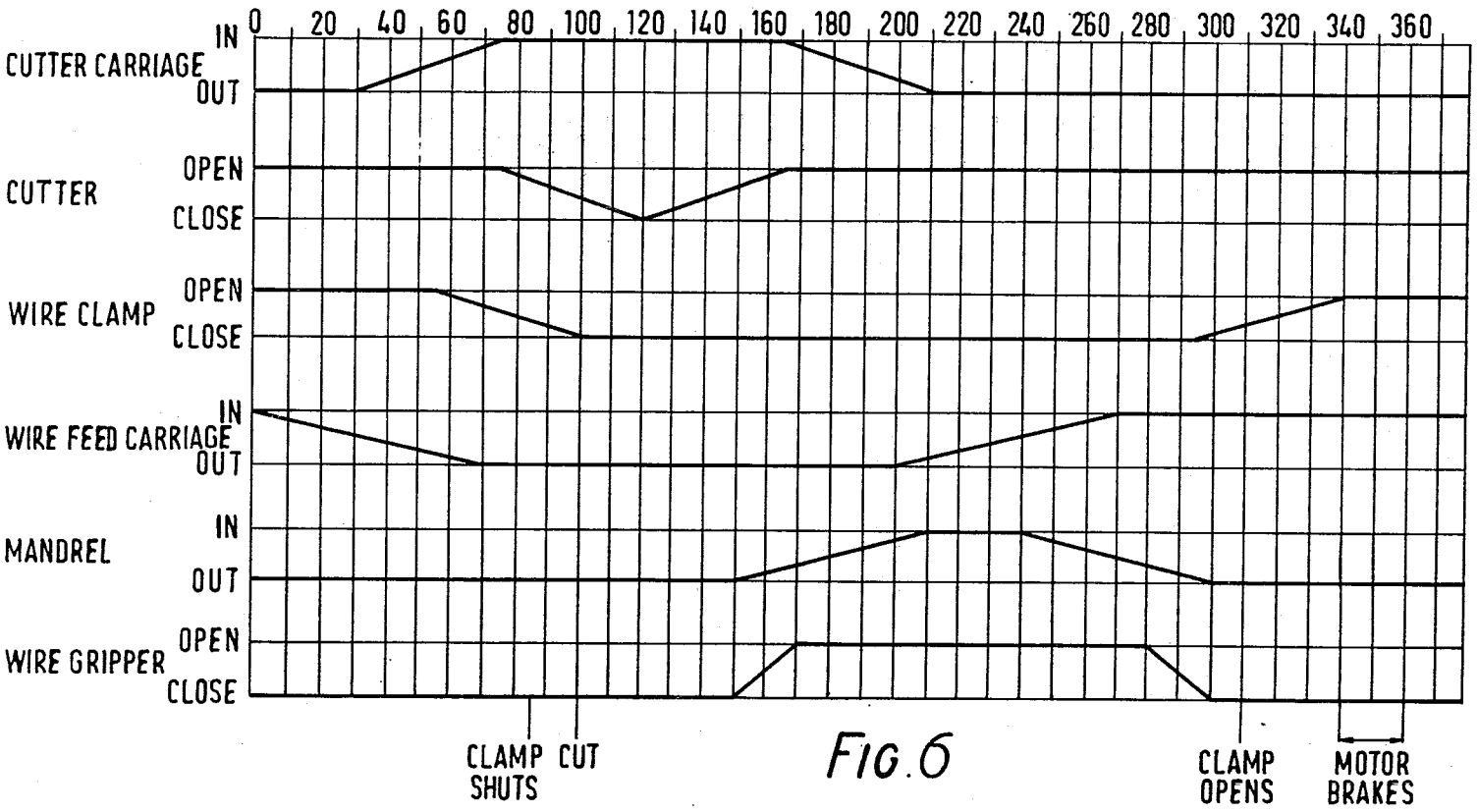
FIG. 6 is a timing diagram showing the control of the mechanically operated parts of the machine mechanism.
Figure 7:
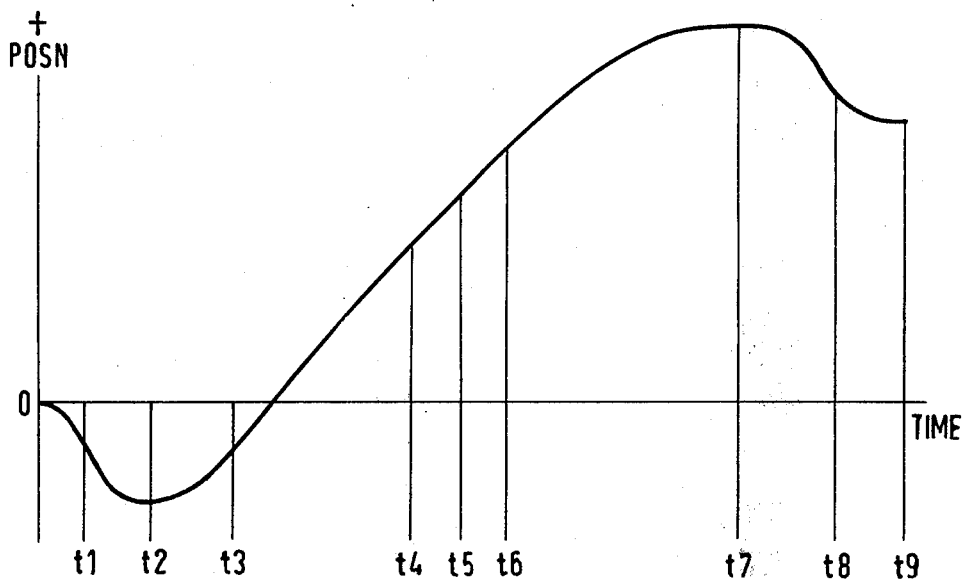
FIG. 7 is a graph showing the operation of the mandrel drive stepping motor plotted against time.

The operation of a typical machine cycle will now be described with particular reference also to FIG. 5 which shows a sequence table for the counter 120. FIG. 6 which is a diagram of the operations carried out by the mechanical drive, and FIG. 7 which shows the operation of the wind motor 5.

At the start of a cycle the situation is basically that the previous filament has been ejected from the mandrel and the electric motor 201 (FIG. 1) for the mechanical drive is operating. This particular situation takes place at approximately 220° of the mechanical cycle (FIG. 6). At this point the wire clamp mechanism D is engaged holding the wire clamped in position on the pitch control carriage 11 between the jaws 30 and 31. The wire feed mechanism C is moving forward to feed the wire to be wound for the next filament to the mandrel 1 which is at this moment still retracted.

Proceeding from this point the wire feed mechanism C continues to move forward and, at 240° of the motor cycle, the mandrel again starts to move forward under the control of its cam (cam shaft 200). The forward feed of the wire ends at 270° while the mandrel continues to move forward up to 300° with the last 20° of the movement being occupied with the closing of the gripper 6 of the wire so as to hold it in position ready for the wind. At 295° the wire clamp mechanism D opens to release the wire and the wire becomes free at 310°. The clamp finishes opening at 340° whereupon the motor 201 is braked to a standstill for the remaining 20° of its operating cycle and a signal "wire fed" (FIG. 5) is fed to multiplex input 122 which has previously been prepared by the de-coder 121. This increases the count in the counter 120 to "1." At this point the binary coded decimal to binary conversion is carried out in the programmer 100 so as to convert the scale factor set in coded digital form into full binary numbers and at the same time arithmetic units 105 and 109 are re-set to "0" if they are not already at "0." also the de-coder 121 has been changed by the increased count and changes the multiplex input for receipt of the signal to provide the next counting pulse. At the end of this conversion and reset operation, a completion signal is produced.

This signal "conversion and reset completed" sets the counter 120 to "2" and starts the winding operation affecting both the wind and pitch motors 5 and 15. The first winding movement is the "prekink wind" which is an initial wind in the reverse direction which controls the angle of the initial filament tail. As a result of this signal, the de-coder 121 then actuates the velocity generator 103 and the two arithmetic units 105 and 109 to provide a reverse drive of the motors 5 and 15, the sense of rotation of the stepping motors being controlled, as previously stated, over the lines 111 and 112. The velocity generator also provides for a pre-determined acceleration of the stepping motors. The angle of the wind motor 5 is counted by the angle counter 108 and when this arrives at a count indicating that half of the winding operation has been carried out, the programmer produces a signal "end acceleration" to the multiplex input 122 whereupon the multiplex input 122 previously prepared by the de-coder 121, passes another signal to the counter 120 increasing the count to "3." The motion of the wind motor 5 up to this point can be seen in FIG. 7 between the time $t_o$ and $t_1$.

The effect of the "end acceleration" signal then changes over the operation of the stepping motors from acceleration to deceleration and the motors then decelerate until the full prekink has been wound, which takes place at the time $t_2$ (FIG. 6). At the end of this period, the velocity generator 103 provides an "end of wind" signal which is fed to the multiplex input 122 and increases the count in counter 120 to "4." This count causes re-setting of the arithmetic units 105 and 109 ready for the next wind step. The resetting of the arithmetic units produces a signal "reset completed" to the multiplex input 122 and brings the counter count to "5."

At this count of "5," the stepping motors 5 and 15 are re-started in the opposite sense and winding takes place to return the prekink at time $t_3$. At this point a "prekink returned" signal is fed through the multiplex input 122 to the counter 120 producing a count of "6."

At the count of "6" the motors 5 and 15 then wind one-half the number of full turns required by the filament ($t_4$). A signal "half whole turns wound" then raises the count to "7" whereupon any required fraction of turns (half of the complete fraction) is wound on in response to a "wind degrees" signal from the de-coder 121. The wind degrees operation finishes at time $t_5$ and a signal "half degrees wound" raises the count to "8."

After the completion of the wind degrees the next wind operation is an overwind. The purpose of the overwind is to ensure the correct positioning of the second tail of the filament and to arrange for the removal of any tension which may have built up in the wire during the winding operation and as a result of the resilience of the winding wire. This overwind operation (half full overwind) takes place between the times $t_5$ and $T_6$.

At the end of this overwind operation the angle counter 108 will indicate that the winding has been half completed and a signal "end acceleration" will be passed to the multiplex input 122 to increase the count of the counter 120 to "9."

It will be appreciated that due to the particular acceleration and deceleration characteristics of the stepping motors, each of winding operations takes place in two parts, the first half with an acceleration and the second half with a deceleration.

Thus as a result of the "end acceleration" signal and the count of "9," the remaining period of time between $t_6$ and $t_7$ provides a winding during deceleration equivalent to the winding which took place between $t_3$ and $t_6$. This winding amount is stored in the velocity generator 103, and thus no further separate signals for the various parts of the winding are required.

At the end of the completion of forced winding which is indicated by an "end of wind" signal fed by the velocity generator 103 to the multiplex input 122, increasing the count of the counter 120 to "10," the next operation is further reset of the two arithmetic units 105 and 109 preparatory to a further reverse winding operation. On the completion of this resetting, a "reset completed" signal is applied to the multiplex input 122 raising the count of the counter 120 to "11" and starting a return overwind operation which causes the motors 5 and 15 to operate in reverse back to the position of the complete wind. As with the previous winding operations, this operation takes place in acceleration and deceleration parts which are controlled by counts "11" and "12" of the counter 120.

At the end of the second half of the return of the overwind, the velocity generator 103 produces an "end of wind" signal and increases the count in the counter 120 to "13."As a result of this count, the mechanical drive motor 201 is re-started and the two arithmetic units 105 and 109 are reset. The mechanical cycle starts again at zero degrees (FIG. 6) and between zero degrees and 70° the carriage 12 of the wire feed mechanism is moved backwards to set the length of tail for the next filament, the wire remaining stationary. After the first 30° of the cycle, the wire cutter mechanism E is moved forward into the line of the wire and this movement finishes at 75°. At 55° the wire clamp mechanism is actuated and the clamp is closed by the arm 38 to clamp the wire rigid with the pitch control carriage 11 ready for the cutting operation at 85°. During this period from 75° the wire cutter mechanism starts to close its jaws and the actual cutting of the wire takes place at 100°. The jaws of the cutter mechanism are then opened to release the wire and at 150° the mandrel retraction mechanism G retracts the mandrel and at the same time the wire gripper 6 opens so that the completed filament is ejected. During the retraction of the mandrel, the wire cutter mechanism E withdraws to its original position out of the line 9 of the wire and this movement is completed at 210°. In the meantime, at 200°, the carriage 12 is again moved forward to feed the wire back to the mandrel 1.

With the completion of the cutting operation, a "reset and cut completion" signal is fed to the multiplex input 122 and increases the count of counter 120 to "14."

The wind motor 5 is then actuated, with the pitch motor 15 being inhibited, and a two part winding operation is carried out to return the stepping motor 5 to its original position, for which purposes it is only necessary to return it through the wind degrees (times $_7$, $_8$ and $_9$. ).

This cycle is controlled by counts "14" and "15." At the end of the cycle, an "end of wind" signal is produced by the velocity generator 103 raising the count to "16," whereupon the arithmetic units 105 and 109 are reset.

Following a "reset completed" signal the count is increased to "17" and produces drive instructions for the return of the pitch mechanism, in two parts (count "17" and "18,"), to its original position. In order to do this, the scale factor (turns/mm) is replaced by a pitch return factor, which many suitably be 20 times smaller than the scale factor. At the end of the return of the pitch control mechanism an end of winding signal increases the count to "19" and initiates a creep check through the photo electric sensor 8 to ensure that the pitch mechanism has returned to its correct position. At the same time a check is made by means of the photo electric sensor 7 to ensure that the stepping motor 5 has also returned to its original position. Should the motors 5 and 15 have not returned to their original position, action would be initiated to correct the return positions. At the end of the time allotted to this the "creep corrected" signal returns the counter count to "0" and provides for further resetting of the arithmetic units 105 and 109.

Then the complete cycle re-starts again with the mechanical cycle at 220° (FIG. 5) and the wire feed starting.

It is to be understood that because of the electronic drive arrangement it is relatively easy to adjust any of the particular parameters required purely by changing the settings on the dials of the programmer. In this way the necessary experiments can be set up and carried out to determine the correct settings to provide the desired filament in a relatively short time, without the necessity of dismantling and replacing gear chains and the like. The relatively simple drive mechanisms for the longitudinal movements present in the winding machine, other than that of the pitch control, are still carried out by mechanical drives since significant or difficult adjustment of these is not required. Furthermore, the wind motor can be vibrated to assist in ejection of the filament if desired.

Up to this point a winding machine has been described in which a filament coil has been wound having radial tails at each end of the coil. It is to be understood however, that the invention is also applicable to machines in which other formations of the coil tails may be used.

Figure 8:
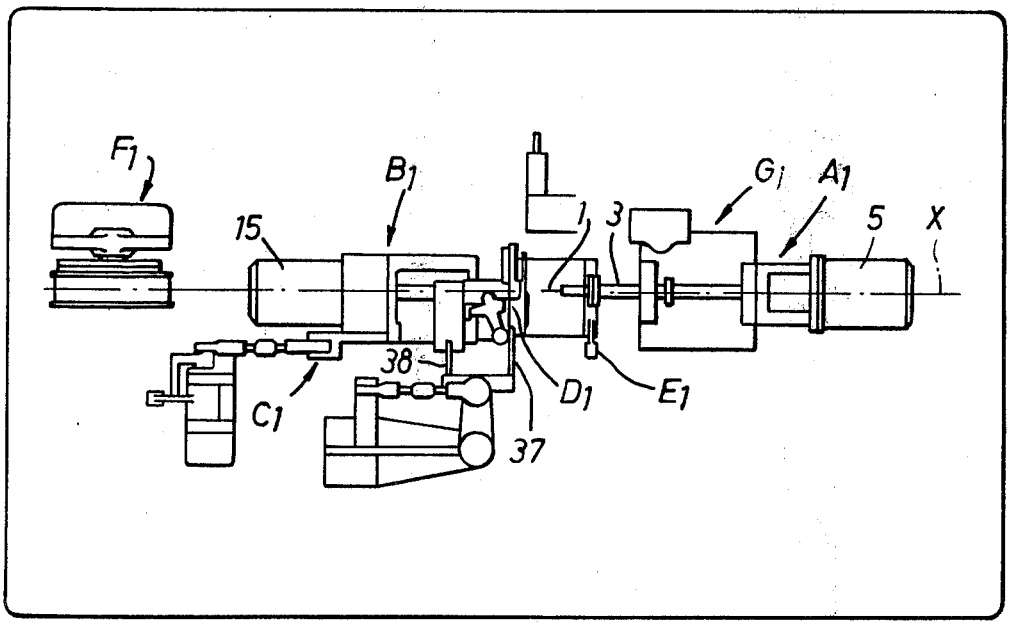
FIG. 8 is a plan view of a second embodiment of a second embodiment of a winding machine according to the invention.

An arrangement for producing axially orientated coil tails is shown in diagrammatic plan view in FIG. 8.

In this particular case the same operational groups are used as in the mechanism shown in FIG. 1, but these groups are differently orientated. Thus the mandrel drive $A_1$ is now on the same axis indicated by X as the second stepping motor 15 of the pitch mechanism $B_1$ and here it will be seen that the pitch mechanism now moves in the same direction as the wire feed mechanism $C_1$. Also orientated along the X axis are the wire clamp mechanism $D_1$, the wire cutter mechanism $E_1$ the wire supply mechanism $F_1$, and the mandrel retraction mechanism $G_1$.

With the exception of this different orientation it will be appreciated that the various parts of the mechanism are effectively the same.

The electronic control system will also be the same except that, because axial tails are being used, there is no necessity to include the "prekink" winding operation which is necessary with the radial tails. With this exception the operation of the arrangement of FIG. 8 is effectively identical to that as previously described.

It will be appreciated that various modifications can be made to the above described embodiments without departing from the scope of the invention, for example, while a mechanical drive has been retained for the remaining movements, it is also possible to provide electronic control of these operations if so required. The exact form of the control operations by means of an electronic circuitry can be varied in order to provide a suitable sequence of operations and the physical construction of the machine can also be varied as required by particular circumstances. In some circumstances, it is desirable to rotate the mandrel at a greater speed than its stepping motor and this can be achieved by suitable gears.

In an alternative form of the invention (not shown) it is possible to replace the stepping motors by master and slave units in which case it is only necessary to control the master unit whereby the slave unit will follow. Control of the master unit may be by any suitable means and for speed of operation, an electronic control is recommended.

The present invention is also applicable to machines with a stationary mandrel with the pitch mechanism wire feed and cutter mechanism rotating around it and to machines with a moving mandrel and a stationary wire feed and cutter mechanism. Of course, appropriate modification will be required both to the mechanism and to the control circuitry.

It will be understood that the above description of the present invention is susceptible to various modification changes and adaptations.

What is claimed is:

1. A coil winding machine comprising a mandrel on which a coil is to be wound, a wire guide for guiding wire onto said mandrel in a correct position for forming a wire coil on said mandrel, a first stepping motor for providing a rotary motion between said mandrel and said wire guide, a second stepping motor, a rotary to straight line motion converting mechanism connected to said second stepping motor for providing a longitudinal displacement between said mandrel and said wire guide and electronic control means comprising a programmer in which desired parameters for controlling said stepping motors for producing a desired coil are set, a velocity generator connected to said programmer for generating a number representative of a desired rotational speed of said mandrel, a clock pulse generator providing clock pulses to said velocity generator, a first arithmetic unit supplied with said number representative of said desired rotational speed of said mandrel and with a fixed scale factor, means for connecting said arithmetic unit to said first stepping motor, a second arithmetic unit supplied with said number representative of said desired rotational speed of said mandrel, with a variable scale factor representing turns per unit distance of the desired coil to be wound and with a wire guide return factor for controlling return operation of said longitudinal movement between said mandrel and said wire guide and means for connecting said second arithmetic unit to said second stepping motor.

2. A machine as defined in claim 1, and comprising an angle counter connected between an output of said first arithmetic unit and said programmer for determining the angular position of said mandrel.

3. A machine as defined in claim 2, comprising a cam shaft, a plurality of cams in said cam shaft, mechanisms driven by said cams on said cam shaft for carrying out further operations of said winding machine, an electric motor for driving said cam shaft and controlled by said programmer and a plurality of cam operated relays operated by cams on said cam shaft for supplying to said programmer information regarding the position of said cam shaft.

4. A machine as defined in claim 3, and comprising a wire feed mechanism for feed of wire to said wire guide a wire cutting mechanism for cutting off wire at the end of a winding operation, a wire clamping mechanism for holding the wire clamped during certain operations of the winding machine, a supply mechanism for feeding a supply of wire to said wire feed mechanism, a mandrel retraction mechanism and lever means connecting said wire feed mechanism said wire cutting mechanisms, said wire clamping mechanism and said mandrel retraction mechanism operatively to said cam shaft through said cams.

* * * * *